US008505334B2

(12) United States Patent
Niikura

(10) Patent No.: US 8,505,334 B2
(45) Date of Patent: Aug. 13, 2013

(54) PERSONAL ORNAMENT

(76) Inventor: Masami Niikura, Tokyo (JP)

( * ) Notice: Subject to any disclaimer, the term of this patent is extended or adjusted under 35 U.S.C. 154(b) by 0 days.

(21) Appl. No.: 13/148,946

(22) PCT Filed: Feb. 1, 2010

(86) PCT No.: PCT/JP2010/051325

§ 371 (c)(1),
(2), (4) Date: Aug. 10, 2011

(87) PCT Pub. No.: WO2010/092884

PCT Pub. Date: Aug. 19, 2010

(65) Prior Publication Data

US 2011/0314866 A1 Dec. 29, 2011

(30) Foreign Application Priority Data

Feb. 10, 2009 (JP) ..... 2009-001250 U
Feb. 25, 2009 (JP) ..... 2009-042980
Apr. 2, 2009 (JP) ..... 2009-090265

(51) Int. Cl.
*A44C 5/04* (2006.01)

(52) U.S. Cl.
USPC ..... 63/5.1; 63/3.1; 224/172; 368/282

(58) Field of Classification Search
USPC ..... 63/4, 3–3.2, 11, 5.1–5.2, 6, 15.45, 63/15.5, 15.6, 15.65, 1.16, 1.17, 41; 368/282; 224/164, 172, 173, 175, 171, 176, 179; 24/116 A, 16 R, 339, 680, 71.1, 129 R, 115 H
See application file for complete search history.

(56) References Cited

U.S. PATENT DOCUMENTS 268,407 A * 12/1882 Hughes ..... 606/203
434,220 A * 8/1890 Whitney ..... 63/11
861,638 A * 7/1907 Condory ..... 63/15.5

(Continued)

FOREIGN PATENT DOCUMENTS

JP H10-137013 A 5/1998
JP 2000-236921 A 9/2000

(Continued)

OTHER PUBLICATIONS

JP 2000236921(A)—Machine Translation.*

(Continued)

*Primary Examiner* — Jack W. Lavinder
*Assistant Examiner* — Abigail E Morrell
(74) *Attorney, Agent, or Firm* — JTT Patent Services, LLC; Gerald T. Peters

(57) ABSTRACT

In the context of a personal ornament, e.g., a finger ring, in which decorative member(s) is/are attached to cord loop(s), making size(s) of loop(s) variable creates the impression of a lighter grip and improves fit. A finger ring has cord made of transparent silicone rubber, support member, and decorative member. Cord is coiled in spiral fashion for two revolutions, forming two loops. One end of cord is secured to through-hole of support member. A portion near the middle of cord is inserted through through-hole of support member, and is capable of moving within through-hole. The other end of cord is secured within through-hole of support member. The two loops of the cord are inserted through decorative member, and cord is capable of moving within decorative member. Absolute and relative sizes of the two loops of cord change automatically in correspondence to changes in finger thickness.

7 Claims, 3 Drawing Sheets

(56) References Cited

U.S. PATENT DOCUMENTS

| | | | | | |
|---|---|---|---|---|---|
| 946,342 | A | * | 1/1910 | Doppenschmitt | 63/11 |
| 993,303 | A | * | 5/1911 | Kirby | 63/11 |
| 1,689,251 | A | * | 10/1928 | Benjamin | 24/115 R |
| 2,031,110 | A | * | 2/1936 | King | 63/3 |
| 2,462,425 | A | * | 2/1949 | Pratt et al. | 63/3 |
| 2,586,758 | A | * | 2/1952 | Zerr | 24/518 |
| 2,811,294 | A | * | 10/1957 | Sand | 224/172 |
| 3,170,311 | A | * | 2/1965 | Raphael | 63/3.1 |
| 3,224,060 | A | * | 12/1965 | Ogden | 24/116 A |
| 3,347,037 | A | * | 10/1967 | Klang | 63/21 |
| 3,974,545 | A | * | 8/1976 | Lossini | 24/116 R |
| 5,341,659 | A | * | 8/1994 | Wright | 63/1.16 |
| 5,370,130 | A | * | 12/1994 | Hess | 128/844 |
| 5,440,900 | A | * | 8/1995 | White | 63/38 |

FOREIGN PATENT DOCUMENTS

| | | | |
|---|---|---|---|
| JP | 3089664 | U | 8/2002 |
| JP | 3092548 | U | 3/2003 |
| JP | 3140698 | U | 4/2008 |

OTHER PUBLICATIONS

Wakabayashi, Accessories—JP2000236921 Translation, Sep. 5, 2000, 1-17.*

International Search Report (ISR) in International Application No. PCT/JP2010/051325 (Publication No. WO 2010/092884 A1).

* cited by examiner

PERSONAL ORNAMENT

CROSS-REFERENCE TO RELATED APPLICATIONS AND INCORPORATION BY REFERENCE

This application is the national phase of International Patent Application No. PCT/JP2010/051325, filed 1 Feb. 2010, which claims priority to Japanese Utility Model Application No. 2009-001250 U, filed 10 Feb. 2009; and further, claims priority to Japanese Patent Application No. 2009-042980, filed 25 Feb. 2009; and further, claims priority to Japanese Patent Application No. 2009-090265, filed 2 Apr. 2009. All of the above-identified patent applications and utility model application are hereby incorporated herein in their entireties by reference.

TECHNICAL FIELD

The present invention relates to a personal ornament such as, for example, a finger ring, necklace, or the like, that has loop(s) of cord (including chain) through which finger(s), neck, or other such part(s) of a user's body may be passed, and that has decorative member(s) attached thereto.

BACKGROUND ART

Known as an example of this type of personal ornament is a finger ring in which a single loop of transparent silicone rubber cord (i.e., a single rubber band) is affixed to a decorative member. When this finger ring is worn on a finger, the finger is inserted through the rubber band, elasticity of the rubber band causing it to tighten around and appropriately fit the finger.

PRIOR ART REFERENCES

Patent References

Patent Reference No. 1: Japanese Patent Application Publication Kokai No. 2000-236921

Patent Reference No. 2: Japanese Utility Model Registration No. 3089664

SUMMARY OF INVENTION

Problem to be Solved by Invention

In a conventional finger ring in which the decorative member is affixed to a single rubber band, the decorative member is unsteadily supported on the finger, orientation of the decorative member having poor stability. This being the case, the decorative member is limited to sizes that are somewhat small, and the decorative member is accordingly limited to design variations that are few in number. Furthermore, while finger size varies depending on person, depending on finger, and depending on whether the finger is straight or bent, size of the rubber band diameter (when unstretched) is constant. This being the case, there are times when the grip of the rubber band around the finger will be too tight or too loose, which causes problems such as the finger ring fitting poorly, instability in the location at which the finger ring is worn, and so forth.

Furthermore, with necklaces, there is a desire to be able to make large changes in the size of the diameter of the cord loop.

In the context of a personal ornament having looped cord(s) and having decorative member(s) attached thereto, it is an object of the present invention to make it possible to adjust size(s) of diameter(s) of cord loop(s).

Means for Solving Problem

A personal ornament in accordance with the present invention comprises a cord coiled in spiral fashion for at least two revolutions so as to form at least two loops through which a part of the user's body may be inserted; and a support member having a through-hole through which that cord may be inserted. The cord emerges from the two openings of the through-hole of the support member. A first portion of the cord that has emerged from one of the openings forms one of the at least two loops, and a second portion of the cord that has emerged from the other of the openings forms another of the loops. While this personal ornament is being worn on the user's body, the two ends of that cord are attached to the support member so as to secure the two ends of that cord to the support member. Moreover, the support member is constituted such that, while this personal ornament is being worn on the user's body, the cord is capable of moving so as to slide within the through-hole. This makes it possible for size(s) of diameter(s) of the at least two loops to vary while this personal ornament is being worn on the user's body.

Decorative member(s) may be attached to one or both of the two loops as component(s) separate from the support member, and/or decorative member(s) may be attached to the support member, and/or decorative member(s) may be constituted by the support member. Where decorative member(s) is/are attached to one or both of the two loops as component(s) separate from the support member, the loop(s) may be capable of moving relative to decorative member(s) in the length direction of the cord. This will make it possible to adjust position of decorative member(s) along the loop(s).

The present invention may be applied to a wide variety of personal ornaments which may be worn on a user's body when some part of the user's body is inserted through the at least two loops thereof; such as finger rings, toe rings (rings that are worn on the toes of the feet), necklaces, armlets, anklets, ankle rings, waist belts, hairbands, and so forth.

As the cord, depending on the application in which the personal ornament is to be used, an elastic cord may be employed, or a nonelastic cord may be employed. Where it is required that the personal ornament fit tightly on a part of the user's body, as might be the case with a finger ring, for example, an elastic cord (e.g., a silicone rubber cord) might be employed. On the other hand, where the personal ornament will be worn loosely on a part of the user's body, as might be the case with a necklace, for example, a nonelastic cord (e.g., metal chain or braided cord) might be employed. Furthermore, the cord may be made from flexible material so as to permit dimensions of the two loops to change in correspondence to cross-sectional shape of the part of the user's body that will be inserted therethrough.

Benefit of Invention

The personal ornament of the present invention is such that a cord forms at least two loops to either side of a support member. Moreover, at least while this personal ornament is being worn on the user's body, the cord is capable of moving so as to slide within the through-hole of the support member, as a result of which the sizes of the diameters of the at least two loops may be made to vary such that one of the loops increases in size while another of the loops decreases in size, at which time the combined length of cord at those two loops is kept constant.

For example, in the case of a finger ring, differences in finger thickness depending on person and depending on which finger is employed, and changes in finger thickness in accompaniment to bending and straightening of the finger, can be accommodated, creating the impression of a lighter grip and improving fit. Moreover, because one of the loops is made to increase in size while another of the loops is made to decrease in size, at which time the combined length of cord at those two loops is kept constant, there is no occurrence of problems such as, for example, the situation in which a finger ring becomes too loose for the finger that it previously fit, which may occur at a time when all loops are first increased in size but thereafter fail to return to their former sizes. Furthermore, for example in the case of a necklace, relative sizes of those two loops might be varied in correspondence to TPO or user's preference, making it possible to vary these to suit one's fancy.

EMBODIMENTS FOR CARRYING OUT INVENTION

Below, a finger ring associated with an embodiment of the present invention is described with reference to the drawings.

Figure 1:
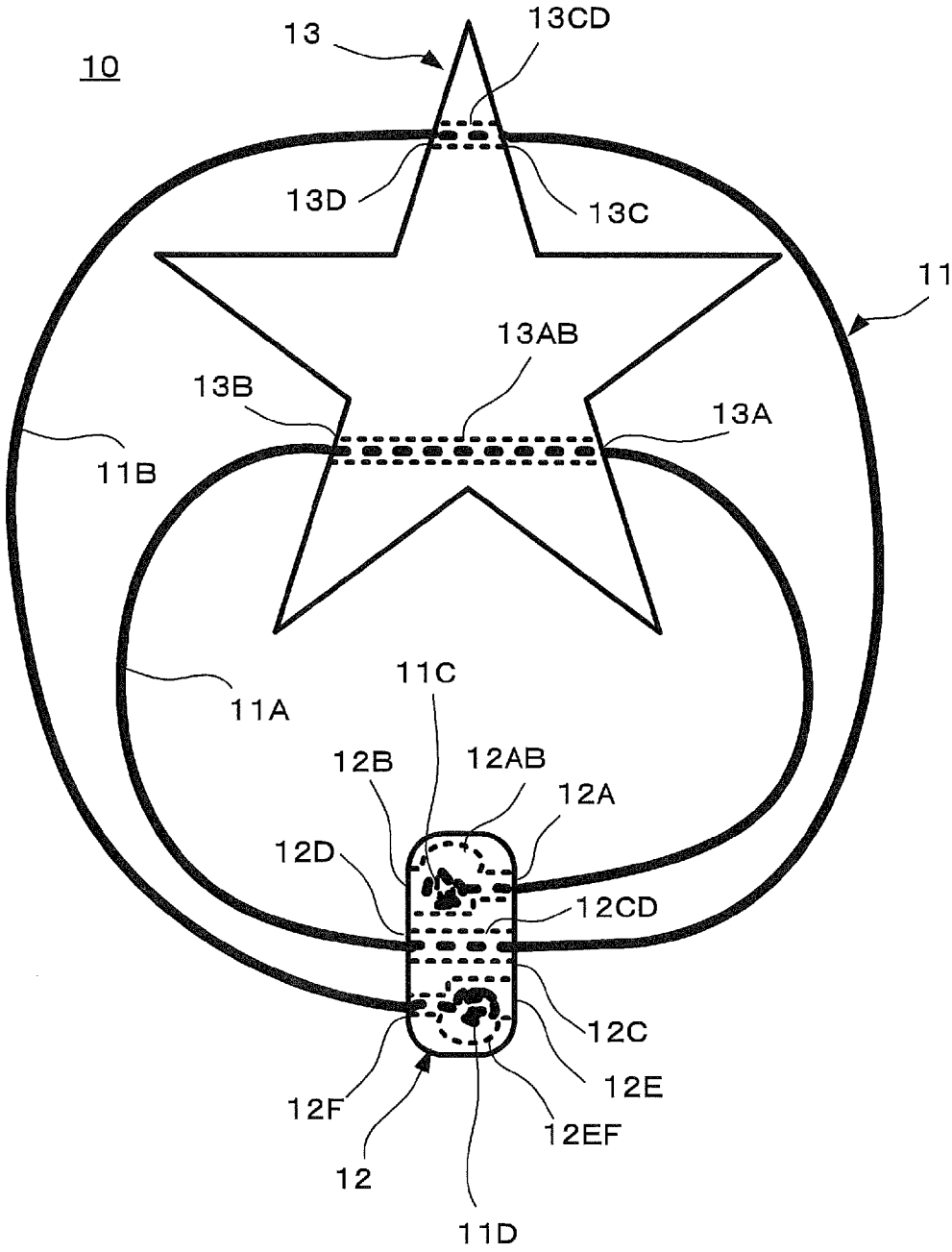
FIG. 1 Drawing showing external appearance and structure of a finger ring which is one embodiment of a personal ornament in accordance with the present invention.

As shown in FIG. 1, finger ring 10 associated with one embodiment of the present invention comprises a cord 11, support member(s) 12 attached to this cord 11, and decorative member(s) 13 attached to that cord 11. Cord 11 might be made from flexible and elastic material such as silicone rubber, for example, so that it is capable of elastic expansion and contraction in its length direction. Cord 11 is coiled in spiral fashion for two revolutions and forms two loops 11A and 11B through which a user's finger may be inserted. Decorative member 13 is attached to the two loops 11A and 11B. Because cord 11 is flexible, the dimensions of the two loops 11A and 11B can change freely in correspondence to the cross-sectional shape of the user's finger that is inserted therein. Cord 11 may be transparent and colorless, so that in terms of the appearance of the finger ring, it is almost as if cord 11 does not exist. Alternatively, cord 11 may be colored and/or may be imparted with some particular esthetic design, so that cord 11 plays an active role in the esthetic appearance of this finger ring.

Support member 12, which might, for example, be made of metal, synthetic resin, stone, glass, or other such rigid material (alternatively, it may be made of flexible material such as, for example, cloth or silicone rubber), has three through-holes, these being first through-hole 12AB, second through-hole 12CD, and third through-hole 12EF. One end 11C of cord 11 is inserted in first through-hole 12AB, end 11C being secured within first through-hole 12AB. A portion near the middle of cord 11 is inserted through second through-hole 12CD, cord 11 is capable of moving so as to slide within second through-hole 12CD. The other end 11D of cord 11 is inserted within third through-hole 12EF, end 11D being secured within third through-hole 12EF. Of the two loops 11A and 11B of cord 11, first loop 11A is formed between first through-hole 12AB and second through-hole 12CD, and second loop 11B is formed between second through-hole 12CD and third through-hole 12EF. Because cord 11 is capable of moving so as to slide in the length direction thereof within second through-hole 12CD, it is possible to adjust the absolute and relative sizes of those two loops 11A and 11B.

Decorative member 13, which also might, for example, be made of metal, synthetic resin, stone, glass, or other such rigid material (alternatively, it may be made of flexible material such as, for example, cloth or silicone rubber), has two through-holes through which cord 11 is respectively inserted, these being fourth through-hole 13AB and fifth through-hole 13CD. The portion of cord 11 corresponding to first loop 11A is inserted through fourth through-hole 13AB, and the portion of cord 11 corresponding to second loop 11B is inserted through fifth through-hole 13CD. Cord 11 is capable of moving so as to slide in the length direction thereof within these through-holes 13AB, 13CD, as a result of which it is possible to adjust the position of decorative member 13 along loops 11A and 11B.

During fabrication of this finger ring 10, the following procedure may be carried out to attach cord 11 to support member 12 and decorative member 13.

That is, one end 11C of cord 11 is inserted through through-hole 12AB of support member 12 such that it enters from one opening 12A and exits from the other opening 12B. Moreover, a knot is tied at the one end 11C of cord 11 where it emerges from opening 12B, this knot being made to enter the interior of support member 12 from opening 12B so that it is completely housed within support member 12 in such fashion that it cannot be seen from the exterior. Adhesive is used to secure this knot (end 11C) within support member 12.

Furthermore, the other end 11D of cord 11 which emerges from opening 12A is inserted through through-hole 13AB of decorative member 13 such that it enters from opening 13A and exits from opening 13B; and from there, is inserted through through-hole 12CD of support member 12 such that it enters from opening 12D and exits from opening 12C; and from there, is inserted through through-hole 13CD of decorative member 13 such that it enters from opening 13C and exits from opening 13D; and finally, is inserted through through-hole 12EF of support member 12 such that it enters from opening 12F and exits from opening 12E. Moreover, a knot is tied at the other end 11D where it emerges from opening 12E, this knot being made to enter the interior of support member 12 from opening 12E so that it is completely housed within support member 12 in such fashion that it cannot be seen from the exterior. Adhesive is used to secure this knot (end 11D) within support member 12. This completes fabrication of finger ring 10.

Figure 2:
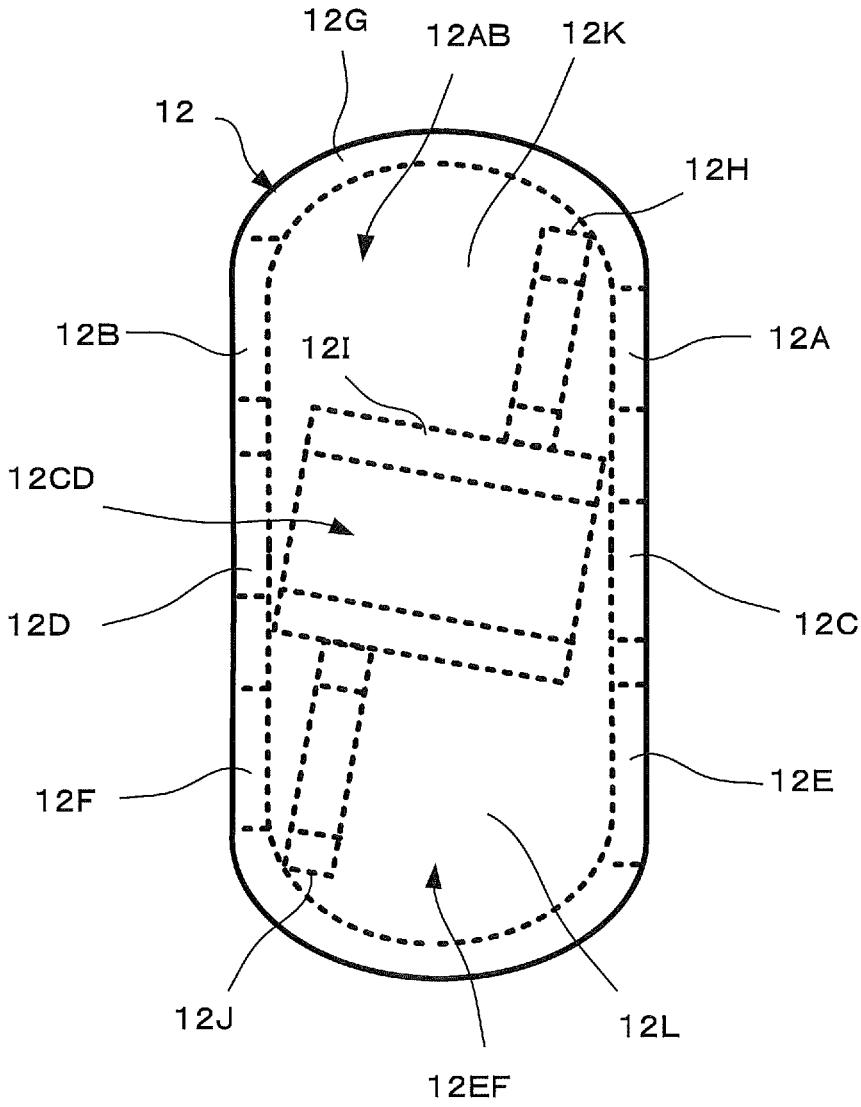
FIG. 2 Front view of a support member which is a component of same finger ring.
Figure 3:
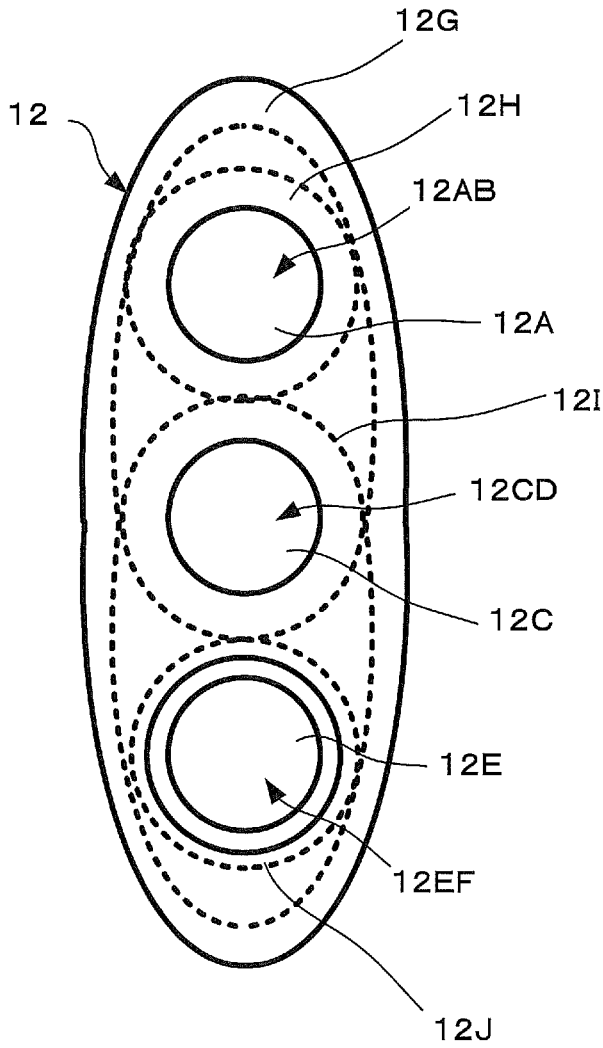
FIG. 3 Side view of same support member.

As shown in FIG. 2 and FIG. 3, support member 12 has box-shaped casing 12G that might be made of metal, for example. The size of casing 12G might, for example, be such that it is on the order of 5 mm long×3 mm wide×2 mm thick. The outer shape of casing 12G is made to have no sharp corners so that it will be pleasant to the touch. Casing 12G is hollow, and as is clear from FIG. 3, the openings 12A, 12B, 12C, 12D, 12E, 12F of the three through-holes shown in FIG. 1 penetrate the two side walls thereof. Housed and secured within the casing are two annular members 12H and 12J for respectively forming through-holes 12AB and 12EF shown in FIG. 1, and one tubular member 121 for forming through-hole 12CD. Respectively disposed between annular member 12H and corresponding opening 12B, and between annular member 12J and corresponding opening 12E, are spaces 12K and 12L for housing the knots at the two ends 11C and 11D of cord 11.

At this finger ring 10, cord 11 is such that the two ends 11C and 11D thereof are secured to support member 12, and a portion near the middle thereof is capable of moving within through-hole 12CD of support member 12. Accordingly, the sizes of the two loops 11A and 11B formed by cord 11 can be made to change such that when one of the loops is made to increase in size the other of the loops will be made to decrease in size, at which time the combined length of cord 11 at those two loops 11A and 11B is kept constant. Furthermore, cord 11 is flexible, and the dimensions of loops 11A and 11B can change freely in correspondence to cross-sectional shape of the finger. This make it possible for the foregoing two loops 11A and 11B to flexibly accommodate differences in cross-sectional shape and/or finger thickness depending on person or depending on which finger is employed. Furthermore, even where, while this finger ring 10 is being worn on a finger, bending or straightening of the finger causes local increase or decrease in thickness at location(s) on the finger and/or causes change in cross-sectional shape of the finger, it will be possible for the foregoing two loops 11A and 11B to flexibly accommodate change in the cross-sectional shape and/or thickness thereof. This causes the user to have the impression that the grip of finger ring 10 on the finger is lighter and that it is a better fit. Furthermore, the fit of finger ring 10 on the finger is improved, and the location at which finger ring 10 is worn is made stable. These advantages are further bolstered by the fact that cord 11 is itself elastic. Furthermore, because one of the loops is made to increase in size while the other of the loops is made to decrease in size, at which time the combined length of cord 11 at those two loops 11A and 11B is kept constant (i.e., because the sizes of the respective loops are automatically adjusted in correspondence to a change in finger size), there is no occurrence of problems such as, for example, the situation in which a finger ring becomes too loose for the finger that it previously fit, which may occur at a time when all loops are first increased in size but thereafter fail to return to their former sizes.

Furthermore, while this finger ring 10 is being worn on a finger, because support member 12 and decorative member 13 cause the two loops 11A and 11B formed by cord 11 to be arranged on the finger such that that they are removed by some distance from each other, there is less unsteadiness in the manner in which decorative member 13 is supported, and orientation of decorative member 13 is made stable. This being the case, there is more latitude with respect to variations on the size of decorative member 13 than would be the case with the conventional finger ring employing a single rubber band, which means that there are increased degrees of freedom for designs with respect to the size of decorative member 13.

Furthermore, because cord 11 is capable of moving within the two through-holes 13AB and 13CD of decorative member 13, it is possible to adjust the location of decorative member 13 on the finger in correspondence to the user's preference.

In addition, because the two ends 11C and 11D of cord 11 are completely housed within support member 12, and because the knots cannot be seen from the exterior, the esthetic aspects thereof are excellent.

While a preferred embodiment of the present invention has been described above, this has been done for purposes of illustrating the present invention, and it is not intended that the scope of the present invention should be limited to only this embodiment. The present invention may be carried out in a wide variety of modes other than that of the foregoing embodiment without departing from the gist thereof. For example, the cord may be coiled in spiral fashion for more than two revolutions so as to form more than two loops. Where this is the case, the support member may have two or more through-holes through which the cord is movably inserted, and/or a plurality of support members may be provided which are respectively allocated to different combinations of the loops thereof. Decorative member(s) may be attached to support member(s), or support member(s) may itself or themselves also function as decorative member(s). This personal ornament may comprise both of: one or more decorative members separate from support member(s), and one or more decorative members attached to support member(s) (or support member(s) may itself or themselves constitute decorative member(s)).

Through-hole(s) provided at support member(s) so that cord can be movably inserted therethrough need not be such that the cord is always movable. It is sufficient that the cord be capable of moving in the length direction thereof within the foregoing through-hole(s) while the finger ring is normally worn on the user's finger. For example, a support member may have a locking mechanism for such a through-hole, such that when this is locked by the user, the location of the cord is fixed in place within the through-hole; and such that when this is unlocked by the user, the cord is made movable within the through-hole. There is no reason why the two ends of the cord must be housed within the interior of the support member, it being possible for these to be disposed exterior to the support member. There is no reason why each of through-holes 12AB, 12CD, 12EF, 13AB, and 13CD shown at FIG. 1 must be a single through-hole, it being possible for any of these to be made up of a series of two more constituent through-holes.

Furthermore, there is no reason why the two ends of the cord must always be secured to the support member, it being sufficient that the two ends of the cord be secured to the support member while the finger ring is normally worn on the user's finger. The personal ornament may be made such that, where necessary, the user can change the locations near the two ends of the cord that are secured to the support member (i.e., so as to permit adjustment of the substantive length of cord that forms the foregoing plurality of loops). For example, there may be a locking mechanism at the attachment locations (e.g., through-holes 12AB and 12EF shown in FIG. 1) at which the two ends of the cord are attached to the support member, such that when this locking mechanism is unlocked by the user, the cord can move in the length direction relative to the attachment location(s); and such that when this locking mechanism is locked by the user, the cord is fixed in place relative to the attachment location(s). Alternatively, surface(s) at the foregoing attachment locations of the support member (e.g., inner surfaces of through-holes 12AB and 12EF shown in FIG. 1) might be kept in contact with the surface of the cord such that a force of friction of some positive magnitude acts therebetween, so that the foregoing force of friction is greater than the tension on the cord during normal use when the finger ring is worn by the user, as a result of which the two ends of the cord do not move relative to the foregoing attachment locations during normal use (which means that, practically speaking, they are substantially fixed in place); but such that when the user intentionally pulls with very strong force on the two ends of the cord, the two ends of the cord move relative to the foregoing attachment locations.

The decorative member need not necessarily be a single component, but may instead be constituted from a plurality of mutually separate constituent decorative members that are respectively attached to the cord. The support member need not necessarily be a single component, but may instead be constituted from a plurality of mutually separate constituent support members that are respectively attached to the cord. For example, the support member may be constituted from a plurality of components that are separable but that are also capable of being joined with each other. For example, the support member may have a first component to which one end 11C of cord 11 shown in FIG. 1 may be attached, and a second component to which the other end 11D of cord 11 shown in FIG. 1 may be attached (one or both of this first and this second component may have through-hole 12CD shown in FIG. 1, or a separate third component having through-hole 12CD may in addition be provided). Moreover, the personal ornament may be such that, while the finger ring is normally worn on the user's finger, these first and second components (or first, second, and third components) join together (e.g., by means of mated engagement, hooking, magnetic attraction, or the like) to form a single support member. On the other hand, the personal ornament may be such that, when the user inserts the user' finger into the finger ring or removes the user's finger therefrom, the support member is separated into first and second components (or first, second, and third components), as a result of which there might be a large increase in size(s) of cord loops(s).

The present invention may be applied not only to finger rings but also to toe rings (rings that are worn on the toes of the feet), necklaces, and a wide variety of other personal ornaments.

EXPLANATION OF REFERENCE NUMERALS

10 Finger ring (personal ornament)
11 Cord
12 Support member
13 Decorative member
12AB, 12CD, 12EF, 13AB, 13CD Through-holes
12A, 12B, 12C, 12D, 12E, 12F, 13A, 13B, 13C, 13D Through-hole openings
11A, 11B Cord loops
11C, 11D Cord ends

The invention claimed is:

1. A personal ornament worn on a user's body when a part of the user's body is passed therethrough, the personal ornament comprising:

a cord coiled in spiral fashion for at least two revolutions so as to form at least two loops through which a part of the user's body may be passed;

a support member having at least one through-hole through which the cord is inserted; and a decorative member separate from the support member;

wherein the cord emerges from two openings of the at least one through-hole of the support member such that a first portion of the cord emerging from one of the openings forms one of the at least two loops, and a second portion of the cord emerging from the other of the openings forms another of the loops;

two ends of the cord are fixedly secured within the support member and maintain a fixed mutual positional relationship;

the support member is constituted such that the cord is capable of moving in a long direction thereof within the at least one through-hole;

the decorative member is attached to the at least two loops; and the at least two loops are capable of moving relative to the decorative member in a length direction of the cord.

2. The personal ornament according to claim 1 wherein the cord is flexible so as to permit dimensions of the at least two loops to change in correspondence to cross-sectional shape of the user's body.

3. The personal ornament according to claim 1 wherein adhesive is used to secure at least one of the two ends of the cord to the support member.

4. The personal ornament according to claim 1 wherein respective sizes of the at least two loops are adjustable, this adjustment being such that when one of the loops is made to increase in size, at least one other of the loops is thereby made to decrease in size, the combined total length of the loops after the adjustment being identical to the combined total length of the loops before the adjustment.

5. The personal ornament according to claim 1 wherein the support member has three through-holes through which the cord is inserted;

the cord is capable of moving in a long direction thereof within a first through-hole;

one of the ends of the cord is fixedly secured within a second through-hole of the support member; and one other of the ends of the cord is fixedly secured within a third through-hole of the support member.

6. The personal ornament according to claim 1 wherein the decorative member has at least two through-holes through which the at least two loops are respectively capable of moving relative to the decorative member in a length direction of the cord.

7. The personal ornament according to claim 1 wherein the cord is transparent and colorless.

* * * * *